US011910990B2

(12) United States Patent
Terry

(10) Patent No.: US 11,910,990 B2
(45) Date of Patent: Feb. 27, 2024

(54) SYSTEM AND METHOD FOR CONTROLLING A MOTOR AT A CONSTANT ROTATIONS PER MINUTE (RPM)

(71) Applicant: Techtronic Cordless GP, Anderson, SC (US)

(72) Inventor: Kevin Terry, Charlotte, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 703 days.

(21) Appl. No.: 17/017,168

(22) Filed: Sep. 10, 2020

(65) Prior Publication Data

US 2020/0405112 A1 Dec. 31, 2020

Related U.S. Application Data

(60) Provisional application No. 62/910,193, filed on Oct. 3, 2019.

(51) Int. Cl.
*A47L 9/28* (2006.01)

(52) U.S. Cl.
CPC ..... *A47L 9/2842* (2013.01); *A47L 9/2831* (2013.01); *A47L 9/2884* (2013.01); *A47L 9/2894* (2013.01)

(58) Field of Classification Search
CPC .... A47L 9/2842; A47L 9/2831; A47L 9/2884; A47L 9/2894; H02P 6/085; H02P 6/153
USPC ..... 318/432, 34
See application file for complete search history.

(56) References Cited

U.S. PATENT DOCUMENTS

| | | | | |
|---|---|---|---|---|
| 6,545,443 | B2 | 4/2003 | Kushida | |
| 6,984,948 | B2 | 1/2006 | Nakata et al. | |
| 8,064,729 | B2 | 11/2011 | Li et al. | |
| 8,294,393 | B2 * | 10/2012 | Schock | H02H 7/097 318/798 |
| 8,350,508 | B2 | 1/2013 | Celik | |
| 8,362,736 | B2 * | 1/2013 | Woodward | H02P 1/16 318/778 |
| 8,373,371 | B2 | 2/2013 | Clothier et al. | |
| 8,395,340 | B2 | 3/2013 | Marvelly | |
| 8,432,114 | B2 | 4/2013 | Clothier | |
| 8,474,095 | B2 | 7/2013 | Clothier et al. | |
| 8,487,569 | B2 | 7/2013 | Dawe et al. | |
| 8,561,253 | B2 | 10/2013 | Clothier et al. | |
| 8,614,557 | B2 | 12/2013 | Clothier et al. | |
| 8,648,552 | B2 | 2/2014 | Dai | |
| 8,710,778 | B2 | 4/2014 | Clothier et al. | |
| 9,001,098 | B2 | 4/2015 | Seo et al. | |
| 9,054,614 | B2 | 6/2015 | Roh | |
| 9,225,281 | B2 | 12/2015 | Dai | |
| 9,301,665 | B2 | 4/2016 | Clothier et al. | |
| 9,742,319 | B2 * | 8/2017 | Marvelly | H02P 6/153 |
| 9,801,516 | B2 | 10/2017 | Zheng et al. | |
| 9,993,129 | B2 | 6/2018 | Santini | |

(Continued)

*Primary Examiner* — David Luo
(74) *Attorney, Agent, or Firm* — Michael Best & Friedrich LLP

(57) ABSTRACT

A cleaning system including a motor configured to provide rotational energy to an impeller, a current sensor configured to sense current provided to the moto, and a controller having an electronic processor. The controller is configured to receive, from the current sensor, a current signal indicative of the current provided to the motor, filter the current signal to produce a filtered current signal, and control the motor based on the filtered current signal.

19 Claims, 6 Drawing Sheets

(56) References Cited

U.S. PATENT DOCUMENTS

| | | | |
|---|---|---|---|
| 2002/0175648 | A1 | 11/2002 | Erko et al. |
| 2015/0265121 | A1 | 9/2015 | Kim et al. |

* cited by examiner

SYSTEM AND METHOD FOR CONTROLLING A MOTOR AT A CONSTANT ROTATIONS PER MINUTE (RPM)

CROSS-REFERENCE TO RELATED APPLICATIONS

This application claims priority to U.S. Provisional Patent Application No. 62/910,193, filed Oct. 3, 2019, the entire contents of which are hereby incorporated by reference herein.

FIELD

Embodiments relate to cleaning systems and methods for controlling the same.

SUMMARY

Cleaning systems, such as vacuum cleaners may have a first actuator (for example, a suction motor) and a second actuator (for example, a brush roll motor). During operation, the first actuator and/or the second actuator may experience varying loads, which may result in varying speeds. Varying speeds may result in reduced quality of operation. For example, In some cleaning systems, when in a low speed mode and introduced to a high load (for example, a carpeted surface) a brush roll motor of the cleaning system may stall. Additionally, different speeds may be desired for different operations based on load.

Thus, one embodiment provides a cleaning system including a motor configured to provide rotational energy to an impeller, a current sensor configured to sense current provided to the moto, and a controller having an electronic processor. The controller is configured to receive, from the current sensor, a current signal indicative of the current provided to the motor, filter the current signal to produce a filtered current signal, and control the motor based on the filtered current signal.

Another embodiment provides a method of controlling a cleaning system including a motor configured to provide rotational energy to an impeller. The method includes sensing, via a current sensor, a current provided to the motor, and receiving, via a controller, a current signal indicative of the current from the current sensor. The method further includes filtering, via the controller, the current signal to produce a filtered current signal, and controlling, via the controller, the motor based on the filtered current signal.

Other aspects of the application will become apparent by consideration of the detailed description and accompanying drawings.

DETAILED DESCRIPTION

Before any embodiments of the application are explained in detail, it is to be understood that the application is not limited in its application to the details of construction and the arrangement of components set forth in the following description or illustrated in the following drawings. The application is capable of other embodiments and of being practiced or of being carried out in various ways.

Figure 1:
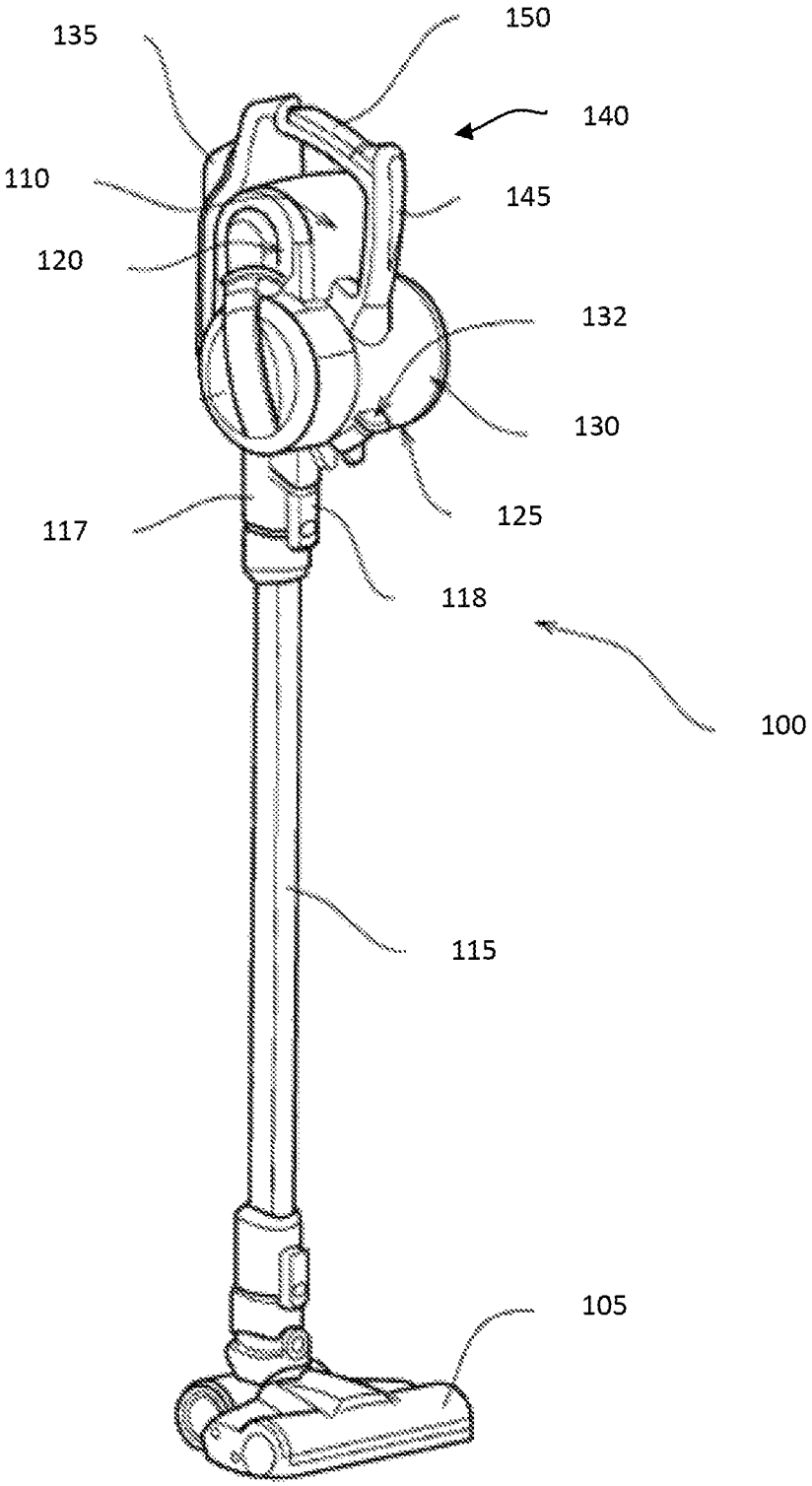
FIG. 1 is a perspective view of a cleaning system according to some embodiments.
Figure 2:
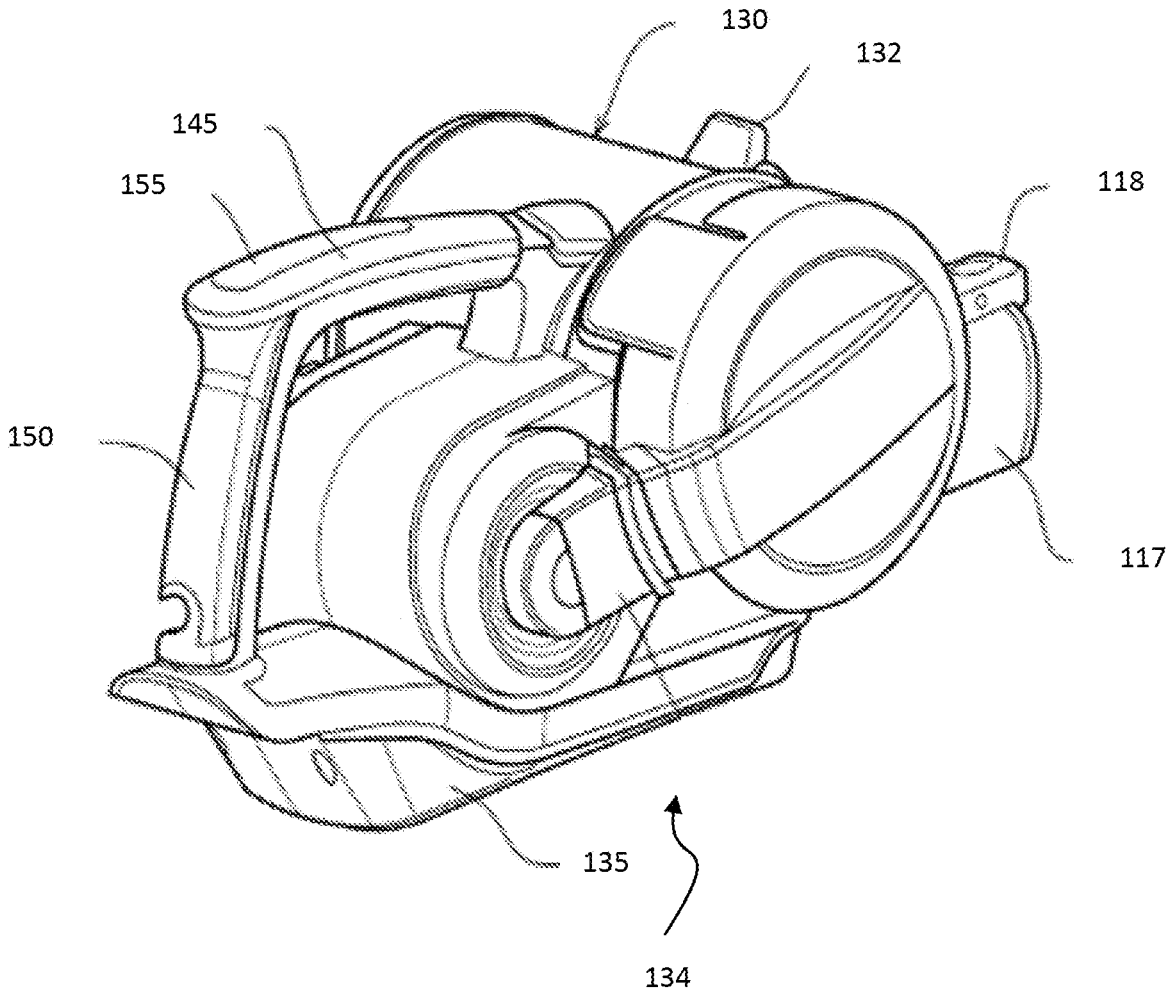
FIG. 2 is a perspective view of a housing of the cleaning system of FIG. 1 according to some embodiments.

FIGS. 1 and 2 illustrate a cleaning system 100 configured to clean a surface (for example, a floor such as a hardwood floor, a carpeted floor, upholstery, etc.) according to some embodiments. Although illustrated as a stick vacuum cleaner, in other embodiments, the cleaning system 100 may be another type of vacuum, such as but not limited to, a handheld vacuum and an upright vacuum. The cleaning system 100 may include a surface cleaning tool 105 (a floor head in the illustrated embodiment), a housing 110, and an elongated member 115 configured to connect the cleaning tool 105 to the housing 110. In some embodiments, the elongated member 115 may be removably coupled to the housing 110 at an inlet 117 via a manually operated switch 118.

The cleaning system 100 may further include a suction source 120, a dirt separation device 125, and a dirt receptacle 130. In some embodiments, the suction source 120 is a motor (for example, an electronic motor) configured to drive a rotor or fan in order to provide suction (for example, at inlet 117 when elongated member 115 is removed). The dirt receptacle 130 may be configured to contain debris collected by the cleaning system 100. In some embodiments, the dirt receptacle 130 is a selectively removable receptacle and/or canister. In such an embodiment, the dirt receptacle 130 may be removed via an actuator member 132. In other embodiments, the dirt receptacle 130 is a removable and replaceable bag.

The cleaning system 100 may further include an energy storage device receptacle 134 configured to releasably receive an energy storage device 135. The energy storage device 135 may be a rechargeable battery having one or more cells connected in series and/or parallel in order to produce a voltage. In some embodiments, the energy storage device 135 may have a chemistry including, but not limited to, an alkaline chemistry, a nickel-cadmium chemistry, a nickel-metal hydride chemistry, and a lithium-ion chemistry. In other embodiments, the energy storage device 135 may be, or include, one or more capacitors (for example, one or more supercapacitors).

The housing 110 may include a handle 140 for a user to grasp. In the illustrated embodiment, the handle 140 includes a first user-graspable portion 145 and a second user-graspable portion 150. The handle 140 may further include a user-interface 155 (FIG. 2). In some embodiments, the user-interface 155 receives a user input from a user for operating the system 100 (for example, turning the system 100 "on" or "off", controlling a mode of the system 100, controlling a brush roll 205 (FIG. 3) of the system 100, etc.).

Figure 3:
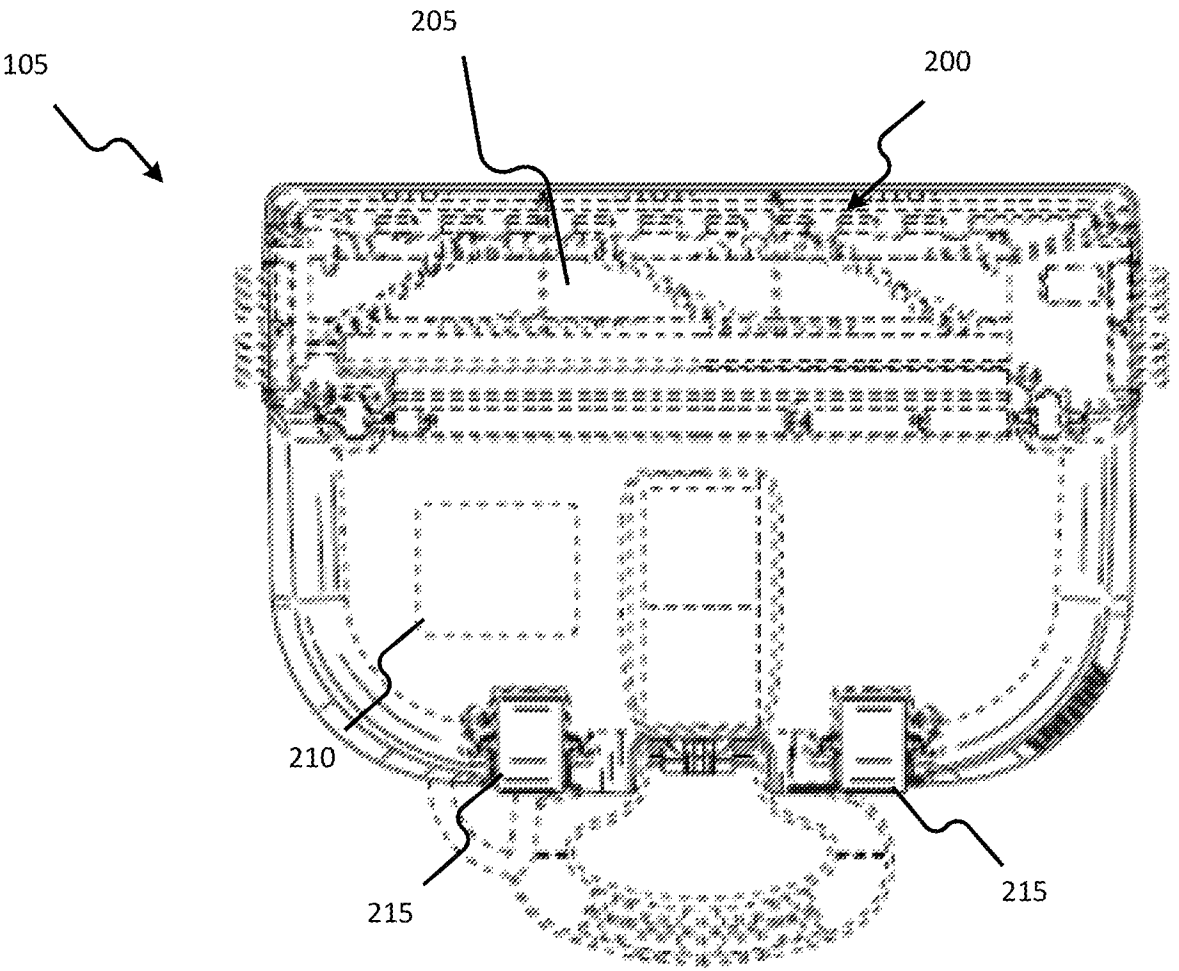
FIG. 3 is a bottom view of a surface cleaning tool of the cleaning system of FIG. 1 according to some embodiments.

FIG. 3 is a bottom view of surface cleaning tool 105 according to some embodiments. In the illustrated embodiment, the tool 105 includes an inlet 200 in fluid communication with inlet 117, a brush roll 205, a brush roll motor 210, and one or more wheel 215 supporting the system 100 on the surface to be cleaned. The brush roll 205 is configured to be rotated, by the brush roll motor 210, in order to agitate dirt and/or debris from the surface to be cleaned.

Figure 4:
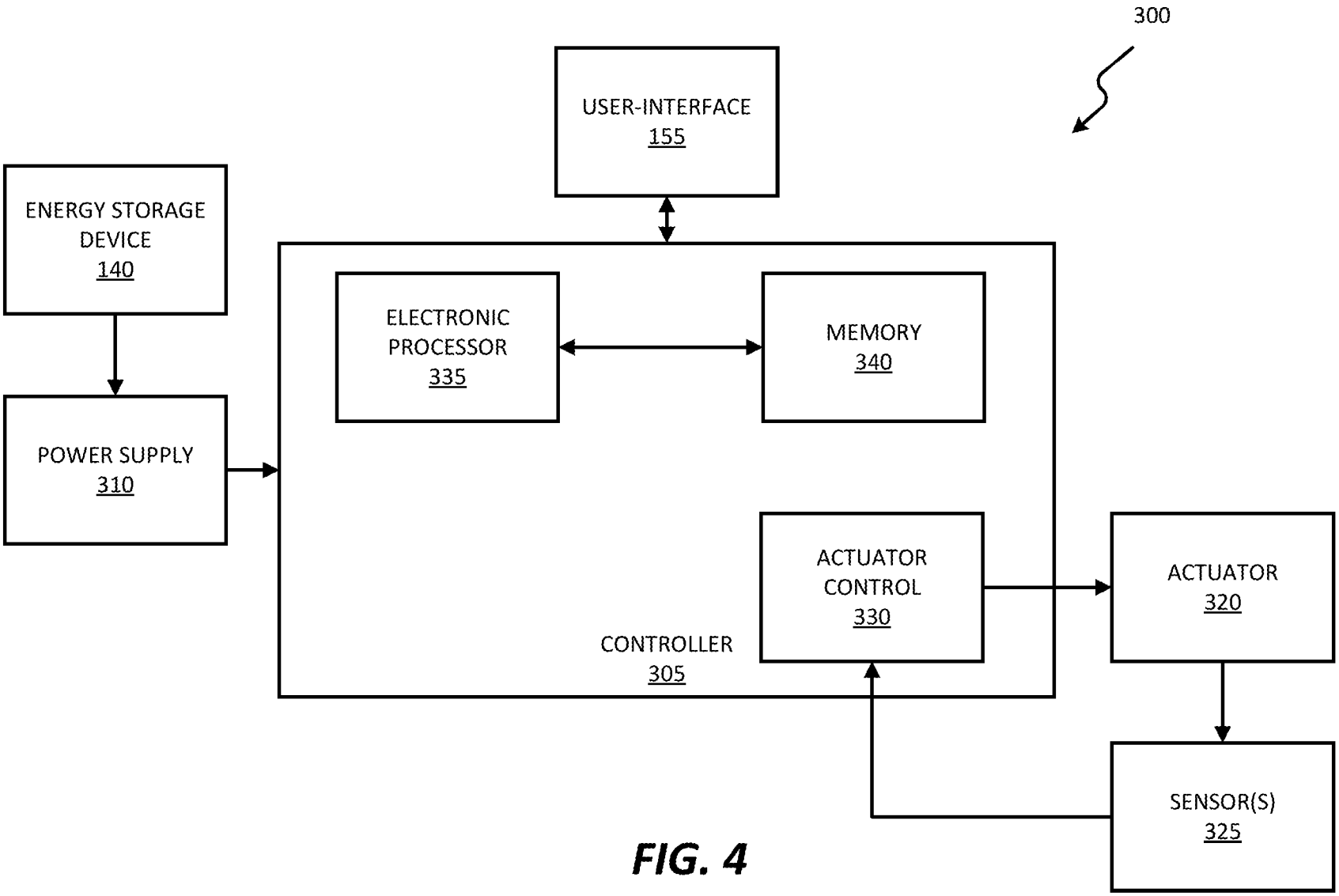
FIG. 4 is a block diagram of a control system of the cleaning system of FIG. 1 according to some embodiments.

FIG. 4 is a block diagram illustrating a control system 300 of the cleaning system 100 according to some embodiments.

The control system 300 includes a controller 305. The controller 305 is electrically and/or communicatively connected to a variety of modules or components of the system 100. For example, the controller 305 is connected to the user-interface 155, a power supply 310, one or more actuators 320, and one or more sensors 325.

In some embodiments, the controller 305 includes a plurality of electrical and electronic components that provide power, operational control, and protection to the components and modules within the controller 305 and/or the system 100. For example, in the illustrated embodiment, the controller 305 includes, among other things, an actuator control 330.

In some embodiments, the controller 305 further includes an electronic processor 335 (for example, a microprocessor or another suitable programmable device) and memory 340. The memory 340 includes, for example, a program storage area and a data storage area. The program storage area and the data storage area can include combinations of different types of memory, such as read-only memory (ROM), random access memory (RAM). Various non-transitory computer readable media, for example, magnetic, optical, physical, or electronic memory may be used. The electronic processor 335 is communicatively coupled to the memory 340 and executes software instructions that are stored in the memory, or stored on another non-transitory computer readable medium such as another memory or a disc. The software may include one or more applications, program data, filters, rules, one or more program modules, and other executable instructions. In some embodiments, the actuator control 330 includes separate electronic processors and memory.

The user-interface 155 may be configured to receive input from a user. In some embodiments, the user-interface 155 includes one or more buttons, switches, indicators, etc. Power supply, or power source, 310 is configured to supply nominal power to the controller 305 and/or other components of the system 100. As illustrated, in some embodiments, the power supply 310 receives power from the energy storage device 135 and provides nominal power to the controller 305 and/or other components of the system 100. In some embodiments, the power supply 310 receives power from a direct-current (DC) power source. In other embodiments, the power supply 310 receives power from an alternating-current (AC) power source (for example, an AC power outlet).

The one or more actuators 320 may include the suction source 120 and/or the brush roll motor 210. The actuator 320 may be controlled via a control signal output by the controller 305 (for example, via the actuator control 330). In some embodiments, the control signal is a pulse-width modulated (PWM) signal having a duty cycle.

The one or more sensors 325 are configured to sense one or more characteristics of the actuator 320. In some embodiments, the characteristic is one or more of a current, a voltage, and a temperature. The one or more sensors 325 output one or more signals indicative of the one or more characteristics to the controller 305.

In general operation, a user operates the user-interface 155 to control the system 100. The controller 305 (for example, via the actuator control 330) controls the actuator 320 (suction source 120 and/or brush roll motor 210) via a control signal. The one or more sensors 325 sense a characteristic(s) of the actuator 320. The controller 305 receives a signal(s) indicative of the characteristic(s) and controls the actuator 320 accordingly (for example, by varying the control signal).

Figure 5:
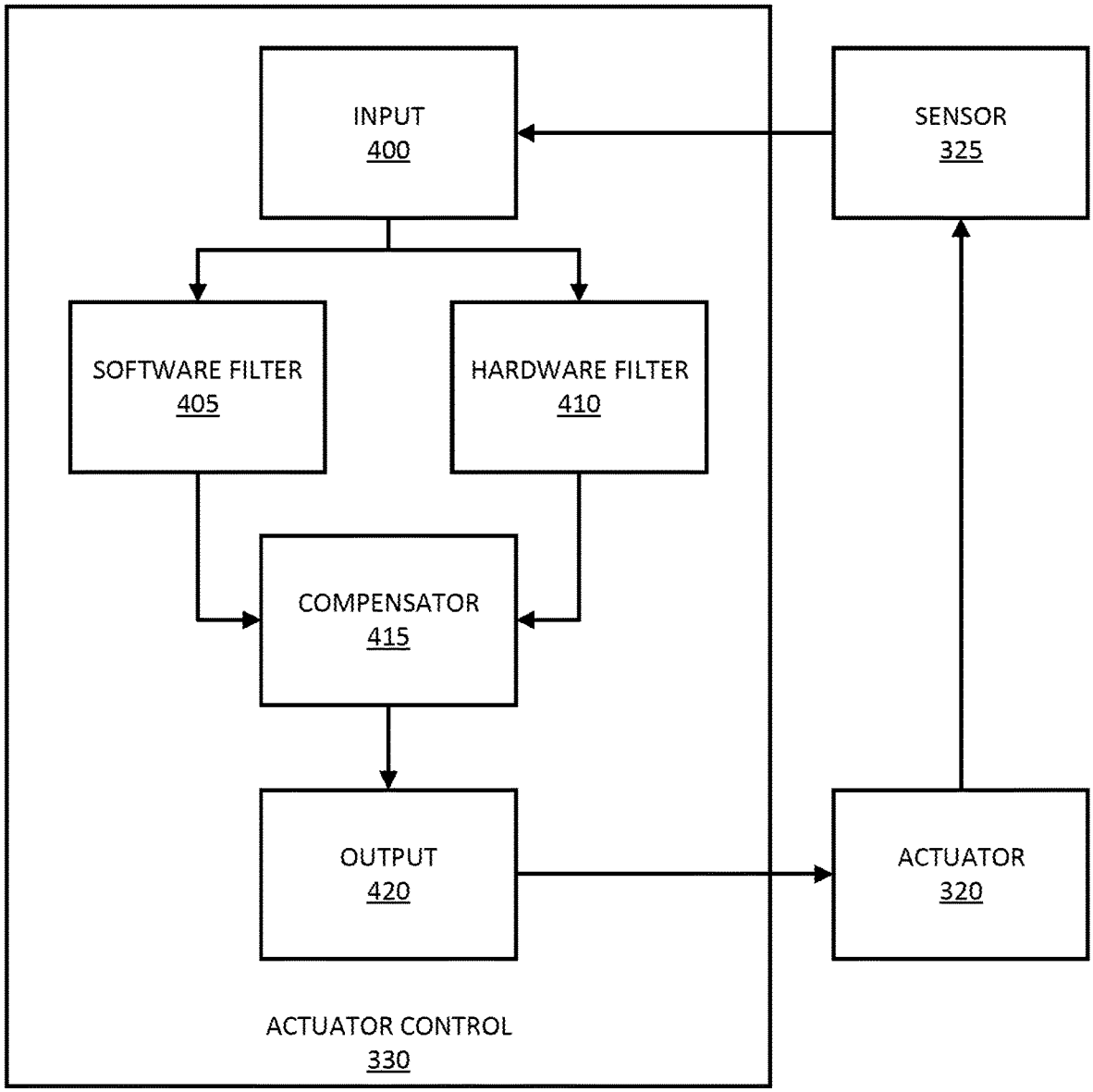
FIG. 5 is a block diagram of an actuator control of the control system of FIG. 4 according to some embodiments.

FIG. 5 is a block diagram illustrating an actuator control 330 according to some embodiments. In some embodiments, actuator control 330 is a control module of controller 305. The actuator control 330 may be implemented in whole or in part in software. In some embodiments, there is no separate module (for example, a separate actuator control 330), but rather the actuator control 330 is implemented using software stored on the memory 340 and executed by the electronic processor 335 of the controller 305. In other embodiments, the actuator control 330 is a separate controller having a memory and electronic processor.

In the illustrated embodiment, the actuator control 330 includes an input 400, a hardware filter 410, a software filter 405, a compensator 415, and an output 420. In some embodiments, the compensator 415 may be implement partially, or in whole, into the software filter 405 and/or the hardware filter 410. The input 400 receives one or more sensed characteristics (for example, a sensed current) of the actuator 320 from the one or more sensors 325.

The one or more sensed characteristics are filtered via the software filter 405 and/or the hardware filter 410. The software filter 405 and/or the hardware filter 410 receive the one or more sensed characteristics (for example, current and/or voltage) and output one or more filtered characteristics (for example, filtered current and/or filtered voltage) to the compensator 415. The software filter 405 and/or the hardware filter 410 may be configured to provide instantaneous filtered characteristic values that are proportional to a load, or approximately proportional to the load. In one embodiment, the filter is a high speed smoothing filter configured to smooth the sensed characteristic with little lag between the instant the characteristic is measured and the time the filtered characteristic is actionable by the controller 305 (or actuator control 330), such as less than approximately 0.5 second lag, or more particularly, less than approximately 0.2 second lag. In one embodiment, the lag is between 0.001 second and 0.1 second, or more particularly less than 0.01 second lag.

The compensator 415 compensates the filtered characteristic based on one or more values. For example, the compensator 415 may compensate the filtered characteristic based on an unladen value and/or a gain value (for example, but not limited to, a feed forward gain value). The unladen value is a reference or baseline value of the measured actuator characteristic. In some embodiments, the unladen value corresponds to a characteristic of the actuator 320 under approximately zero load or other desired operating state. In one example, the unladen value is a predetermined current of a brushroll motor operating on a hard surface. The unladen value may be a predetermined value, or may be a function of a baseline or reference value. In one embodiment, the reference or unladen value is a maximum operating current.

The gain value is a value selected for scaling changes to the control signal. In some embodiments, the gain value corresponds to a value configured to increase or decrease current supplied to the actuator 320. The gain value may be a function of factors including performance attributes of the actuator and the mode that the actuator operates in. In one embodiment, the actuator is a motor, and the gain value is a function of the speed of the motor, the rated voltage or power of the motor, the filter speed, and/or the operating mode of the cleaner. In one embodiment, the gain value(s) are determined empirically based on system performance in selected cleaning operations. The gain value(s) may be different from one cleaning system to another due to differences in system components and/or parameters. In one embodiment, the gain value is selected based on the mode of the cleaner, such as a low speed brushroll mode, a high speed brushroll mode, or an auto-speed brushroll mode. In such an embodiment, the gain value may be selected based on the sensed characteristic indicative of the mode. For example, when the cleaner 100 is in a first mode, a first gain value is used, and when the cleaner 100 is in a second mode, a second gain value is used. In some embodiments, the gain value may be set to "over compensate" allowing the speed of the actuator 320 to increase when additional load is present on the actuator 320. In one embodiment of an over compensation mode, the gain value may be selected such that the speed of the actuator 320 increases when additional load is present on the actuator 320 and decreases when less load is present on the actuator 320. In such an embodiment, the cleaner 100 may operates in an "automatic" mode whereby the speed of the actuator 320 increases and/or decreases automatically depending upon the load, such as a brushroll increasing and/or decreasing speed based on the load imparted by operation on floors, increasing load caused by various carpet types and/or decreasing loads caused by various hard floor types.

The actuator control 330 outputs a control signal, via output 420, to the actuator 320 based on the filtered and/or compensated characteristic(s), for example, current, in order to maintain the actuator 320 at a substantially constant rotations per minute (RPM) for selected operating conditions. In some embodiments, the actuator 320 is maintained at a substantially constant RPM independent of a voltage supplied to the actuator 320. In some embodiments, the actuator 320 is maintained at a substantially constant RPM while a load present on the actuator 320 varies. In some embodiments, the actuator 320 is maintained at a first substantially constant RPM for a first operating condition (for example, an operating condition desired for operation on a first floor type) and a second substantially constant RPM for a second operating condition (for example, an operating condition desired for operation on a second floor type), where the operating condition is based on the filtered and/or compensated characteristic(s).

In one embodiment of operation, a current of the actuator 320 is sensed via the sensor 325. The current is filtered and/or compensated by the controller 305 and/or the actuator control 330. The controller 305 and/or the actuator control 330 vary a control signal supplied to the actuator 320 based on the filtered and/or compensated current as further discussed below. In some embodiments, this process is continually repeated in order to maintain the actuator 320 at a substantially constant RPM for selected operating conditions, such as, but not limited to, while a load present on the actuator 320 varies.

In some embodiments, when operating at a low speed, the actuator 320 may suffer reduced torque, which in prior art cleaners could cause a low speed brushroll to stall on certain floor types, such as thick carpet. The above embodiment of operation may be used to vary (for example, increase the duty cycle of the PWM signal) the control signal supplied to the actuator 320 in order to provide more drive current, and thus compensate for any additional load that may be present on the actuator 320.

Figure 6:
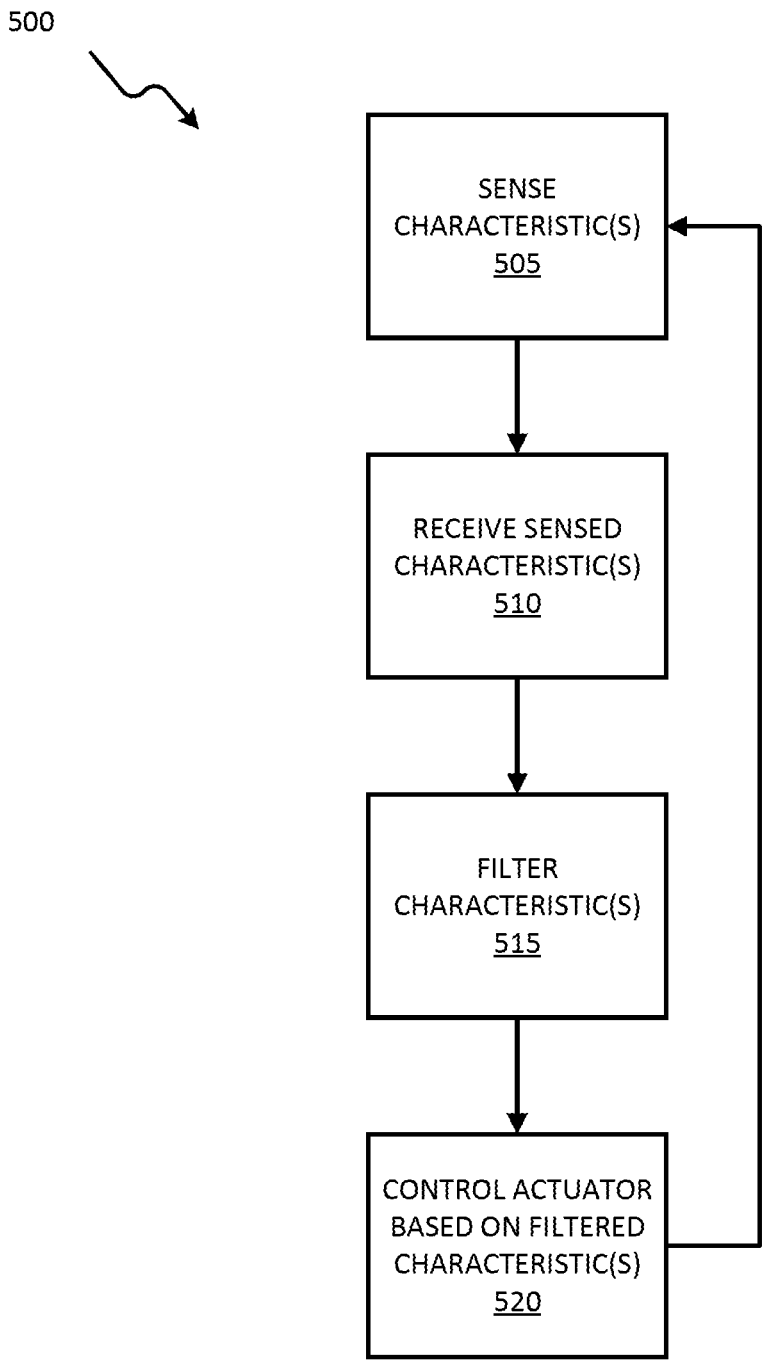
FIG. 6 is a flow chart illustrating a process of the cleaning system of FIG. 1 according to some embodiments.

FIG. 6 is a flowchart illustrating a process, or operation, 500 of the cleaning system 100 according to some embodiments. It should be understood that the order of the steps disclosed in process 500 could vary. Furthermore, additional steps may be added and not all of the steps may be required. One or more characteristics, via sensor 325, of the actuator 320 are sensed (block 505). As discussed above, in some embodiments, the one or more characteristics include a current supplied to the actuator 320.

Controller 305 receives, from sensor(s) 325, a signal indicative of the characteristic (block 510). Controller 305 (and/or actuator control 330) filters the signal to produce a filtered signal (block 515). In some embodiments, the filtered signal may also be compensated via compensator 415. In such an embodiment, the filtered signal may be compensated based on an unladen value and/or a gain value. In such an embodiment, the unladen value may be an unladen current value.

Controller 305 (and/or actuator control 330) controls the actuator (or motor) 320 according to the filtered current signal (block 520). In some embodiments, the actuator 320 is controlled in order maintain a substantially constant RPM. Process 500 then cycles back to block 505.

In one embodiment of operation, the actuator 320 is controlled in a low-speed RPM hold mode. In such an embodiment, the filtered current of the actuator 320 is received by the controller 305 (and/or the actuator control 330). The controller 305 (and/or the actuator control 330) subtract the predetermined unladen current from the sensed current resulting in a current difference.

When the current difference is greater than a predetermined amount, the controller 305 (and/or the actuator control 330) changes the control signal provided to the actuator 320 (for example, by increasing or decreasing the duty cycle of the PWM signal) by an amount calculated by the current difference multiplied by the gain value. In some embodiments, such an amount is calculated by the compensator 415. The predetermined amount may be selected to be a value below which correction of a change in current is not needed, but above which correction of a change in current is desired. For example, if the sensed current is 0.7 amps and the predetermined unladen current is 0.5 amps, the current difference is equal to 0.2 amps. The current difference (approximately 0.2 amps) is multiplied by the gain value (for example, approximately 29), equaling approximately 5.8. The duty cycle of the PWM control signal is then increased by approximately 5.8. In such an example, having a duty cycle scale of 255, and a duty cycle setting of 60/255, the new duty cycle will be approximately 65.8/255. The process will then repeat itself. In the present example, the gain value 29 was empirically derived for maintaining a low speed mode of approximately 500 RPM.

In another embodiment of operation, the actuator 320 is controlled based on modes. In such an embodiment, the user of the cleaner selects a mode of operation, such as a low speed brushroll mode or a high speed brushroll mode, or a hard floor mode or a carpet mode, or other desired modes, using, for example, user-interface 155 in communication with the controller 305. The controller 305 may be configured to operate the cleaner in a desired operation for each mode. In one example, the low speed brushroll mode may include operation of an actuator (for example, brush roll motor 210) driving brushroll 205 at a lower speed, such as between 400 and 1200 RPM, or other speeds as desired, and the high speed brushroll mode may include operation of an actuator (for example, brush roll motor 210) driving brushroll 205 at a higher speed, such as between 1200 and 6000 RPM or other speeds as desired. Alternatively or additionally, the mode may include an actuator (for example, suction source 120) operating a suction motor at an increased or decreased speed as desired for the mode, such as decreased speed for reduced energy consumption or increased speed for increased cleaning performance.

In one embodiment, the user selects a first mode, for example a low speed brushroll mode. The controller 305 initially operates the actuator at a predetermined power programmed for the selected first mode. In such an embodiment, the filtered current of the actuator 320 is received by the controller 305 (and/or the actuator control 330). The unladen drive current is subtracted from the measured current resulting in a current difference. If the current difference is greater than a predetermined amount, the controller 305 (and/or the actuator control 330) increases or decreases the control signal (for example, by increasing or decreasing the duty cycle of the PWM signal) by an amount calculated by a current difference multiplied by a first gain value selected for operation in the first mode (for one example, 29) to maintain the desired speed in the first mode.

In one embodiment, the user selects a second mode, for example a high speed brushroll mode. The controller 305 initially operates the actuator at a predetermined power programmed for the selected second mode. In such an embodiment, the filtered current of the actuator 320 is received by the controller 305 (and/or the actuator control 330). The unladen drive current is subtracted from the measured current resulting in a current difference. If the current difference is greater than a predetermined amount, the controller 305 (and/or the actuator control 330) increases or decreases the control signal (for example, by increasing or decreasing the duty cycle of the PWM signal) by an amount calculated by a current difference multiplied by a second gain value selected for operation in the second mode (for one example, 10) to maintain the desired speed in the second mode.

In another embodiment of operation, the controller 305 can automatically change the actuator 320 from a first mode to a second mode based on the load on the actuator. The controller 305 initially operates the actuator at a predetermined power programmed for the first mode, for example a low speed mode. In such an embodiment, the filtered current of the actuator 320 is received by the controller 305 (and/or the actuator control 330). When the sensed current is less than a predetermined current threshold indicating operation in the first mode, the unladen drive current is subtracted from the measured current resulting in a current difference. If the current difference is greater than a predetermined amount, the controller 305 (and/or the actuator control 330) increases or decreases the control signal (for example, by increasing or decreasing the duty cycle of the PWM signal) by an amount calculated by a current difference multiplied by a first gain value selected for operation in the first mode (for one example, 29).

When the sensed current is greater than the predetermined threshold indicating operation in the second mode, the controller 305 (and/or the actuator control 330) increases the control signal to a predetermined power programmed for the selected second mode. Then the unladen drive current is subtracted from the measured current resulting in a current difference. If the current difference is greater than the predetermined amount, the controller 305 (and/or the actuator control 330) increases or decreases the control signal (for example, by increasing or decreasing the duty cycle of the PWM signal) using a second gain value which may be less than the first gain value selected for operation in the second mode (for one example, 10), operating in an increased RPM in the second mode. If the measured current is less than the predetermined current threshold, the controller decreases the power to the predetermined power programmed for the first mode to return operation to the first mode.

In other embodiments of operation, the controller 305 (and/or the actuator control 330) controls the actuator 320 according to two or more gain values. For example, when the sensed current is less than a first predetermined threshold, the actuator 320 is controlled according to a first gain value selected for operation in a first mode; when the sensed current is greater than the first predetermined threshold but less than a second predetermined threshold, the actuator 320 is controlled according to a second gain value selected for operation in a second mode; and when the sensed current is greater than the second predetermined threshold, the actuator 320 is controlled according to a third gain value selected for operation in a third mode.

The predetermined current threshold may be selected to distinguish operating conditions. In one embodiment, the predetermined current threshold is selected such that the sensed current is less than a predetermined current threshold for a cleaner operating on a first floor type, such as a hard floor, and the predetermined current threshold is selected such that the sensed current is greater than the predetermined current threshold for a cleaner operating on a second floor type, such as a carpet or other floor type. In the load over-compensation mode embodiment of operation, when the sensed current is less than the predetermined current threshold, the compensator uses the first gain value to maintain the RPM at a first speed selected for operation on the first floor type. When the sensed current is greater than the predetermined threshold, the compensator uses the second gain value to provide a step change to a second speed selected for operation on the second floor type. In one example, the predetermined current threshold and first gain value are selected to maintain a lowered speed on a hard floor, such as for example between approximately 400 and approximately 1200 RPM, and the second gain value is selected to index the speed to a higher speed for a carpeted floor, such as for example between approximately 1200 and approximately 6000 RPM.

In another embodiment of operation, the actuator 320 is controlled in a load overcompensation mode, enabling an auto-speed mode based on floor load, or floor type. In such an embodiment, the filtered current of the actuator 320 is received by the controller 305 (and/or the actuator control 330). The unladen drive current is subtracted from the measured current resulting in a current difference. If the current difference is greater than a predetermined amount, the controller 305 (and/or the actuator control 330) increases or decreases the control signal (for example, by increasing or decreasing the duty cycle of the PWM signal) by an amount calculated by a current difference multiplied by a gain value selected for operation in the overcompensation or auto mode (for one example, 36). In this embodiment, the selected gain value is selected such that as sensed current increases or decreases, the controller increases or decreases respectively the control signal (for example, by increasing or decreasing the duty cycle of the PWM signal, scaled such that a low sensed current corresponds to a low speed selected for a low-load floor type such as a hard floor, and a high sensed current within the actuator's operating range corresponds to a higher speed selected for a higher-load floor type such as a carpeted floor. In this embodiment, the speed of the actuator 320 continuously changes with load, decreasing with decreasing sensed current and increasing with increasing sensed current. In this embodiment, the speed of the brushroll is automatically adjusted based on load caused by floor type. The control relationship between current and speed may be linear or non-linear. In this embodiment, the system automatically adjusts as the cleaner passes from hard floor (low load) to carpet (higher load) and from carpet back to hard floor (two way floor control).

In one embodiment of overcompensation mode, the gain value is selected to automatically increase actuator speed with increasing load, but not decrease automatically as load decreases. In such an embodiment, when sensed current increases and actuator speed increases to a high speed mode, the controller maintains the speed until the current decreases to a predetermined current threshold, at which time the controller 305 (and/or the actuator control 330) decreases the power to a predetermined power programmed for a low speed mode to return operation to the lower speed. In this embodiment, the system 100 automatically adjusts as the cleaner passes from hard floor (low load) to carpet (higher load) but may not automatically adjust from carpet back to hard floor (one way control). The controller 305 (and/or the actuator control 330) may have to decrease the power to the actuator 320 to return to low speed.

The gain values may be a function of desired operating mode, the actuator performance, empirical testing, filter speed, and/or other factors. In some embodiments, a given actuator, such as a brushroll motor, a smaller gain value is useful for maintaining constant high speed operation and a higher gain value is useful for maintaining a low speed operation. For example, a gain between 4-12 for a high speed mode, and more particularly 10 for one example cleaner maintaining about 3000 RPM, and between 20 and 32 for a low speed mode, and more particularly 29 for one example cleaner maintaining about 500 RPM. In one embodiment, the gain value for an over compensation mode is selected to allow the actuator to increase with increasing measured current and decrease with decreasing measured current in repeatable and stable control. In this embodiment, the system 100 automatically adjusts as the cleaner passes from hard floor (low load) to carpet (higher load) and from carpet back to hard floor (two way control). For one example actuator, the gain value for a repeatable and stable control in a two way floor control overcompensation mode was 36. In some embodiments, an excessive gain value causes the actuator to increase with increasing load but unlikely to decrease when load decreases. In such an embodiment, the system 100 automatically adjusts as the cleaner passes from hard floor (low load) to carpet (higher load) but may not automatically adjust from carpet back to hard floor (one way control). For one example actuator, the gain value for a one way floor control overcompensation mode was greater than 40.

In some embodiments of operation, a first actuator (for example, suction source 120) is controlled proportionally to a second actuator (for example, brush roll motor 210). For example, the first actuator may operate according to a first control signal (for example, a first duty cycle) when the second actuator has a sensed current less than a predetermined threshold (for example, when the second actuator is operating at a relatively low load); and operate according to a second control signal (for example, a second duty cycle greater than the first duty cycle) when the second actuator has a second current greater than the predetermined threshold (for example, when the second actuator is operating at a relatively heavy load).

Embodiments provide, among other things, a method of operating a cleaning system having an actuator operated at a substantially constant RPM. Various features and advantages of the application are set forth in the following claims.

What is claimed is:

1. A cleaning system comprising:

a motor configured to provide rotational energy to an impeller;

a current sensor configured to sense current provided to the motor; and a controller having an electronic processor, the controller configured to receive, from the current sensor, a current signal indicative of the current provided to the motor, filter the current signal to produce a filtered current signal, and control the motor based on the filtered current signal, wherein the controller controls the motor to operate at a first substantially constant rotations per minute when the current signal is less than a predetermined current threshold, and to operate at a second substantially constant rotations per minute when the current signal is greater than the predetermined current threshold.

2. The cleaning system of claim 1, wherein the controller controls the motor further based on a gain value.

3. The cleaning system of claim 2, wherein the gain value is a predetermined value.

4. The cleaning system of claim 1, wherein the controller controls the motor based on a first gain value when the current signal is less than the predetermined current threshold, and a second gain value when the current signal is greater than the predetermined current threshold.

5. The cleaning system of claim 1, wherein the controller controls the motor further based on the current compared to an unladen current.

6. The cleaning system of claim 5, wherein the unladen current is a predetermined value.

7. The cleaning system of claim 1, wherein the controller controls the motor to operate a substantially constant rotations per minute (RPM).

8. The cleaning system of claim 1, wherein the controller controls the motor via a pulse-width modulated (PWM) signal.

9. The cleaning system of claim 1, further comprising a battery configured to supply power to the motor.

10. The cleaning system of claim 9, wherein the battery is a rechargeable battery pack.

11. The cleaning system of claim 9, wherein the controller controls the motor independent of a voltage of the battery.

12. A method of controlling a cleaning system including a motor configured to provide rotational energy to an impeller, the method comprising:

sensing, via a current sensor, a current provided to the motor;

receiving, via a controller, a current signal indicative of the current from the current sensor;

filtering, via the controller, the current signal to produce a filtered current signal;

controlling, via the controller, the motor based on the filtered current signal; and operating the motor at a first substantially constant rotations per minute when the current signal is less than a predetermined current threshold, and operating the motor at a second substantially constant rotations per minute when the current signal is greater than the predetermined current threshold.

13. The method of claim 12, wherein the motor is further controlled based on a gain value.

14. The method of claim 13, wherein the gain value is a predetermined value.

15. The method of claim 14, further comprising controlling the motor based on a first gain value when the current signal is less than the predetermined current threshold, and a second gain value when the current signal is greater than the predetermined current threshold.

16. The method of claim 12, wherein the motor is further controlled based on the current compared to an unladen current.

17. The method of claim 16, wherein the unladen current is a predetermined value.

18. The method of claim 12, wherein the motor is operated at a substantially constant rotations per minute (RPM).

19. A cleaning system comprising:

a motor configured to provide rotational energy to an impeller;

a current sensor configured to sense current provided to the motor; and a controller having an electronic processor, the controller configured to receive, from the current sensor, a current signal indicative of the current provided to the motor, filter the current signal to produce a filtered current signal, and control the motor based on the filtered current signal, wherein the controller controls the motor based on a first gain value when the current signal is less than a predetermined current threshold, and a second gain value when the current signal is greater than the predetermined current threshold.

* * * * *